US005631681A

United States Patent [19]

Klaus et al.

[11] Patent Number: 5,631,681

[45] Date of Patent: May 20, 1997

[54] INK REPLENISHING SYSTEM AND METHOD FOR INK-JET PRINTERS

[75] Inventors: Richard I. Klaus, Barcelona, Spain; Eric L. Ahlvin, Vancouver, Wash.

[73] Assignee: Hewlett-Packard Company, Palo Alto, Calif.

[21] Appl. No.: 412,647

[22] Filed: Mar. 29, 1995

[51] Int. Cl.[6] ..... B41J 2/175

[52] U.S. Cl. ..... 347/85

[58] Field of Search ..... 347/85, 86, 87, 347/23; 141/329, 330, 114; 137/68.29; 222/DIG. 1, 214, 325, 81, 82

[56] References Cited

U.S. PATENT DOCUMENTS

| | | | |
|---|---|---|---|
| 4,178,595 | 12/1979 | Jinnai et al. | 347/23 |
| 4,187,511 | 2/1980 | Robinson | 347/85 |
| 4,258,865 | 3/1981 | Val et al. | 222/214 |
| 4,967,207 | 10/1990 | Ruder | 347/7 |
| 5,136,305 | 8/1992 | Ims | 347/85 |
| 5,479,968 | 1/1996 | Sanchez et al. | 347/85 |
| 5,505,336 | 4/1996 | Montgomery et al. | 222/82 |

FOREIGN PATENT DOCUMENTS

| | | |
|---|---|---|
| 0639501 | 2/1995 | European Pat. Off. . |
| 3401071 | 7/1985 | Germany . |

OTHER PUBLICATIONS

Hewlett–packard Patent Application S/N: 08/220,767, Filed Mar. 30, 1994; "Ink–Jet Printer Cartridge Refilling Method And Apparatus".

*Primary Examiner*—Benjamin R. Fuller
*Assistant Examiner*—Judy Nguyen

[57] ABSTRACT

A system and method is described for replenishing the ink in ink reservoirs of the printhead cartridges on ink-jet printers. The ink-jet printer includes a replenishing station to which the pen carriage can be moved whenever ink in one of the cartridge ink reservoirs becomes exhausted or nears exhaustion. At the replenishing station, a plurality of container holders serve to receive and hold one or more ink supply containers, which are sealed packages or cans containing an appropriate quantity of ink for refilling the ink reservoir without overfill. A container of the correct ink color is positioned in the appropriate holder where it rests on a hydraulic coupling device which is urged upwardly to a decoupled position by a spring. Downward pressure exerted on the container, preferably by the user closing the replenishing station cover, forces the container downwardly onto a cutting blade or other perforating device which breaks the seal on the container. Further downward pressure presses the coupling device onto the printhead cartridge completing a hydraulic connection from the interior of the container through the coupling to the cartridge. The downward pressure on the container causes ink to flow under pressure from the cartridge container through the coupling to the refill port and into the cartridge. The ink container is designed to crush almost to zero volume, so that all the ink flows into the cartridge. Once refilling is completed, the cover is raised, decoupling the hydraulic connection and allowing the user to remove the crushed container. The system eliminates the need to remove the cartridge from the printer for refilling and also eliminates all contact with the ink.

9 Claims, 4 Drawing Sheets

INK REPLENISHING SYSTEM AND METHOD FOR INK-JET PRINTERS

TECHNICAL FIELD

The present invention relates generally to systems for replenishing the ink in the ink reservoirs on ink-jet printhead cartridges. More particularly, the invention provides a built-in system, incorporated integrally into an ink-jet printer housing, and method, for refilling printhead cartridges without having to remove the cartridges from the printer and exposing the user to ink.

BACKGROUND ART

Most ink-jet printers employ integrated printhead cartridge units which house both an ink dispensing printhead or pen and one or more ink supply reservoirs. A single ink reservoir generally is provided in a monochrome cartridge containing black ink, and three separate ink reservoirs are provided in a tricolor cartridge containing colored inks. The ink reservoirs on printhead cartridges have not heretofore been designed for refilling. Nevertheless, refilling devices have been marketed which allow users to replenish the ink in certain types of cartridges. One such refilling device employs a syringe having a needle that is inserted into the air vent hole on top of a cartridge. Ink is forced into the reservoir via the needle. Syringe-type mechanisms can be messy, requiring the user first to fill the syringe from an ink bottle and then to transfer it to the cartridge. It is also easy to overfill the cartridge using a syringe.

Despite the drawbacks of existing ink-jet printhead cartridge refill mechanisms, replenishing the ink in the cartridge reservoir is desirable. Refilling is usually more economical than replacing the cartridge each time the ink is exhausted. It also avoids the premature disposal of the cartridge itself, allowing it to be re-used multiple times. What is needed, however, is a reliable ink refill system for cartridges that eliminates the messiness of prior art syringe refill devices, thereby further encouraging refill and reuse of printhead cartridges.

DISCLOSURE OF THE INVENTION

The invented system and method address the problem of replenishing the ink in the printhead supply reservoir of an ink-jet printer by providing a built-in ink replenishing station in the printer. The printhead carriage on which one or more printhead cartridges is supported can be moved to the ink replenishing station whenever an additional supply of ink is needed. A sealed ink supply container containing the desired color of ink is positioned at the station whenever the refill procedure is performed. Ink is automatically transferred from the supply container to the printhead cartridge in accordance with the system of the present invention.

The ink replenishing apparatus comprises a frame on which the printhead cartridge is supported. The frame is preferably part of the body or housing of the ink-jet printer. A movable carriage is provided on the frame for supporting and transporting one or more printhead cartridges, each of which supplies ink of a selected color to an ink-jet printhead. One function of the carriage is to direct droplets of ink ejected by the printheads onto paper or other print media at selected locations to form printed images. Each printhead cartridge on the carriage contains one or more ink reservoirs for supplying ink to its printhead. In the present invention, the movable carriage is designed to move the one or more printhead cartridges to an ink resupply position or replenishing station whenever the ink in one or more of the ink reservoirs requires replenishing.

Adjacent the ink replenishing station on the printer is an ink supply container holder designed to hold one or more ink supply containers which are preferably disposable or recyclable cans, bottles or bags in which ink for replenishing the ink reservoirs is contained. A refill port is provided on each printhead cartridge through which ink is supplied to the ink reservoir. A hydraulic coupler is movably supported on the frame adjacent the replenishing station for transferring ink from a supply container positioned on a container holder to a predetermined cartridge ink reservoir. Each of the hydraulic couplers is preferably a movable conduit which can be moved to a coupled position in which the conduit provides a hydraulic connection between a supply container in the holder and the refill port on a cartridge, and is also movable to a decoupled position in which the hydraulic connection is broken. Each coupler preferably is operatively connected to the container holder on the printer such that when a container is placed on the holder the hydraulic connection can be completed by pressing down on the container. Pressing on the container also concurrently moves the coupler to its coupled position. A punch, knife, or other suitable container opener is provided on the hydraulic coupler to open the supply container and allow ink to flow out of the container, through the coupler, and into the ink reservoir on the cartridge.

The invention eliminates the need to remove printhead cartridges from the printer when refilling the ink reservoirs. A movable member such as a hinged lid supported on the frame adjacent the container holder provides a suitable means for exerting force against a container positioned in one of the holders. The movable member also can be used to crush, or partially crush or collapse, the ink container to aid in forcing ink from the container through the coupler to the ink reservoir. A person using the invention is never exposed to ink because it always remains sealed either within the supply container, the coupler, or the ink reservoir of the printhead cartridge. The invention can also prevent overfilling of the ink reservoirs by disabling the movement of the printer carriage to the resupply position except when the ink supply is low.

These and other objects and advantages of the present invention will be understood more readily upon consideration of the drawings and the detailed description of the preferred embodiment, which is set forth below.

DETAILED DESCRIPTION OF THE PREFERRED EMBODIMENT AND BEST MODE OF CARRYING OUT THE INVENTION

Figure 1:
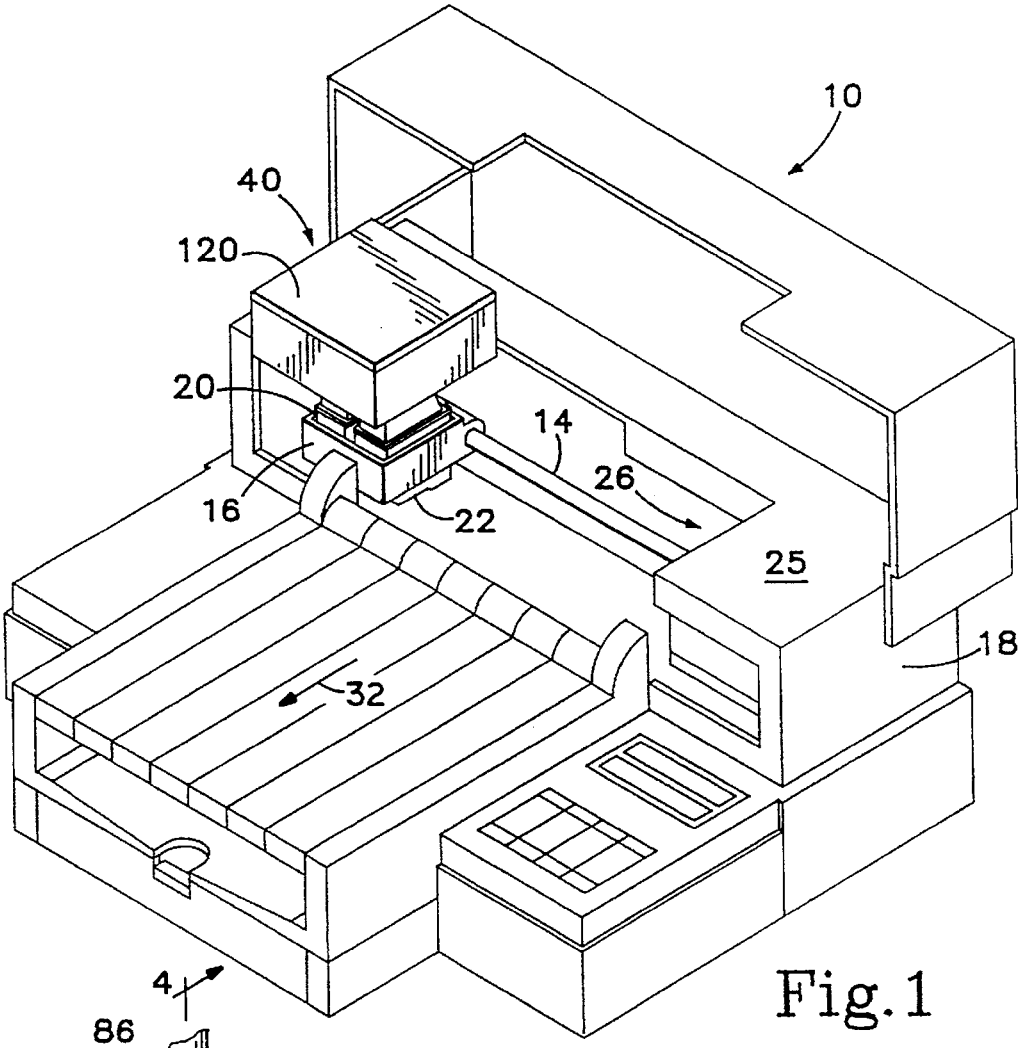
FIG. 1 is an isometric view of an ink-jet printer incorporating an ink replenishing station in accordance with the present invention.

FIG. 1 is an isometric view of an ink-jet printer 10 which incorporates the ink replenishing system of the present invention. Printer 10 includes a laterally extending carriage support track or rod or shaft 14 on which a printhead carriage mechanism 16 is movable laterally across the frame or housing 18 of the printer. One or more printhead cartridges 20, 22 are supported on carriage 16. Cartridges 20, 22 are shown in FIG. 1 at the extreme left end of carriage support rod 14, in a location where the preferred embodiment system and method of the present invention is carried out, as described in detail below. At the extreme right end of carriage support rod 14, beneath a cover 25 on housing 18, is a carriage location 26 generally referred to as a service station. Except during printing operations, or when the ink replenishing system of the present invention is in use, carriage 16 will ordinarily be positioned at service station 26, at the right end of the carriage support, where necessary servicing occurs such as wiping, spitting and capping of the printheads.

Figure 2:
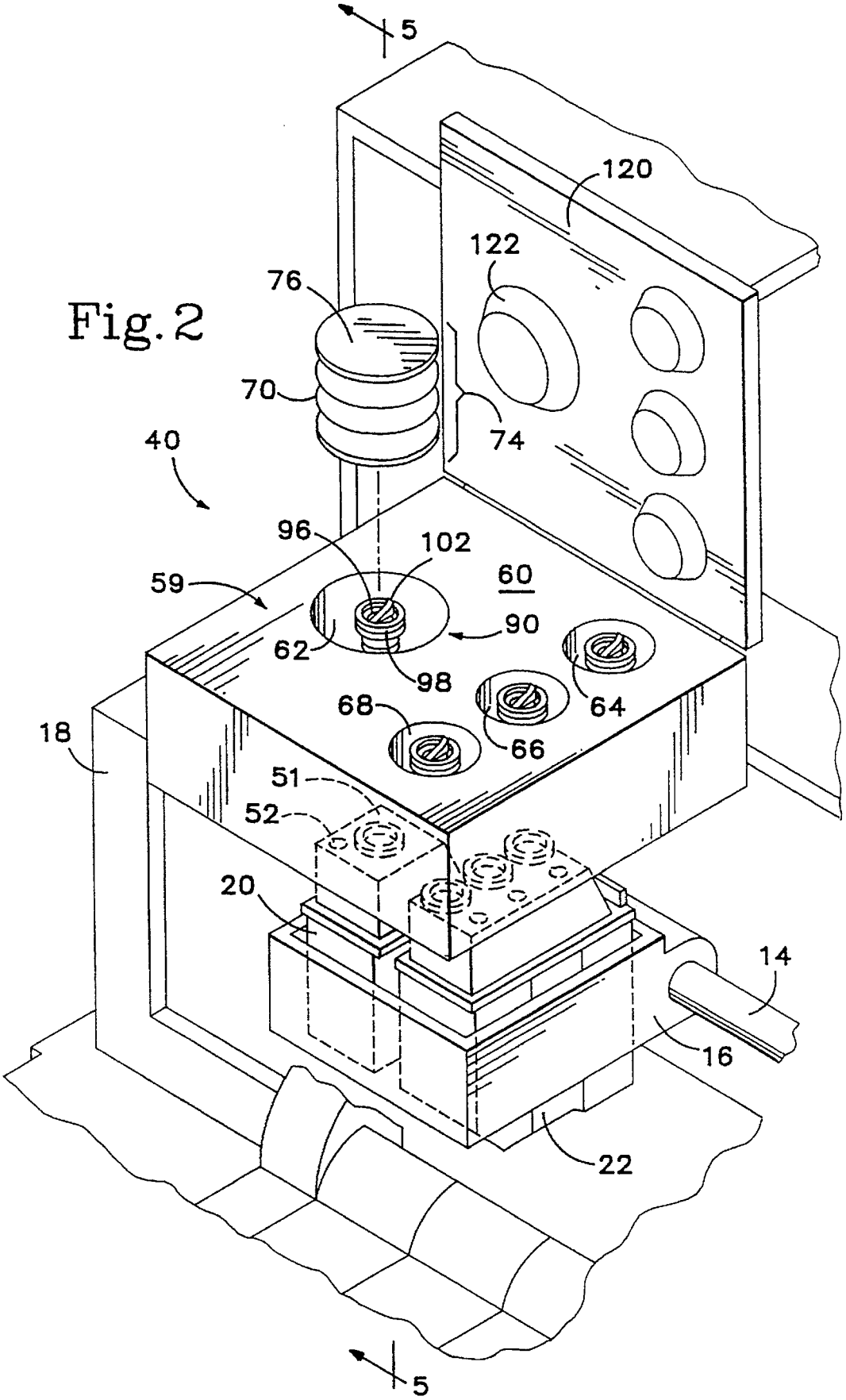
FIG. 2 is an enlarged isometric view of the ink replenishing station on the printer of FIG. 1 illustrating parts of the station when it is in use.

For the purposes of describing the present invention, the left printhead cartridge 20 on carriage 16, as viewed in FIGS. 1 and 2, is assumed to be a monochrome pen for depositing black ink on print media by means of an ink-jet printhead on the underside of the cartridge. The right printhead cartridge 22 on carriage 16 is a tricolor pen containing inks of three different colors (i.e., cyan, magenta and yellow). The printhead on cartridge 22 selectively deposits colored inks on print media. During a print operation, carriage 16 reciprocates laterally along carriage support rod 14 while the printheads on the undersides of cartridges 20, 22 selectively deposit ink droplets on a sheet of paper or other print media (not shown) which is moved slowly and in a controlled manner through the printer in the direction of arrow 32.

As part of the present invention, the housing 18 of printer 10 incorporates an ink resupply position or replenishing station 40 at the extreme left end of carriage support rod 14. Carriage 16 is moved by the printer's controller (not shown), e.g., in response to a user's pushing a control panel pushbutton, to resupply position 40 whenever the ink in one of the cartridges 20, 22 requires replenishment. It would be desirable, in a printer incorporating the ink replenishing system of the present invention, for the printer to include an automatic system for determining the quantity of ink in one or more of the ink reservoirs in the printhead cartridges 20, 22. One such system is the subject of a co-pending patent application, Ser. No. 07/951,255, filed Sep. 25, 1992, entitled "DROP COUNT-BASED INK-JET PRINTER CONTROL METHOD AND APPARATUS," invented by Paul D. Gast, Eva M. Moon and Steve Elgee, which is assigned to the assignee of the present invention, the disclosure of which is incorporated herein by reference. Other suitable systems for determining the quantity of ink the ink reservoirs of the printhead cartridges could alternatively used in a printer incorporating the present invention, including user observation of the print level in the cartridges. Regardless of the system employed for detecting, a "low ink" condition in one or more of the printhead cartridges, will trigger either an automatic movement by the printer of carriage 16 to replenishing station 40 or the illumination of an indicator lamp or the like which alerts the operator to move the carriage to the replenishing station. Once the carriage has arrived at the replenishing station, ink is supplied to the one or more cartridges which need replenishment using the system and method of the present invention.

Ink resupply position 40 is illustrated in an enlarged isometric view in FIG. 2. In the description which follows, the apparatus and method for replenishing the ink in monochrome cartridge 20 will first be described in detail, followed by a brief description of the very similar system and method used when replenishing the ink in tricolor cartridge 22.

Figure 3:
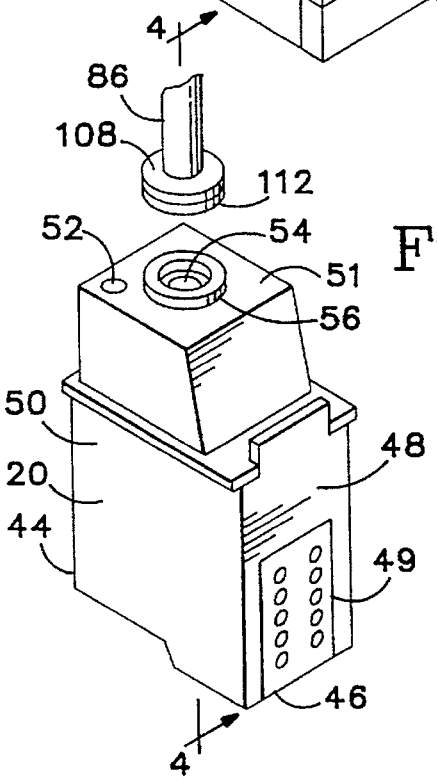
FIG. 3 is an enlarged isometric view of a printhead cartridge used in the printer of FIG. 1 incorporating a refill valve in accordance with the system described herein, and also showing a part of the hydraulic coupling used in the replenishing station of FIG. 2.
Figure 4:
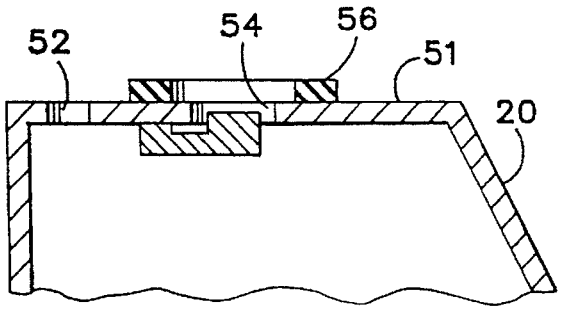
FIG. 4 is a partial cross sectional view, taken along line 4—4 of FIG. 3 illustrating the refill port on a printhead cartridge.

Referring to FIGS. 2–4, printhead cartridge 20 includes a generally rectilinear enclosure 44 made of plastic or another hard, impervious material. An ink-jet printhead is located on the underside 46 of the cartridge and the rear wall 48 (as viewed in FIG. 3) of cartridge 20 includes a contact pad 49 containing numerous electrical contacts for completing electrical connections with the printer. The printhead and electrical contacts are standard features of ink-jet printhead cartridges and are well known to those skilled in the art. An ink reservoir 50 encompasses the majority of the interior volume of cartridge enclosure 44. In order to absorb and hold ink in reservoir 50, and to prevent it from flowing freely and in an uncontrolled manner through the printhead nozzles on the underside 46 of cartridge 20, ink reservoir 50 is customarily filled with an absorbent foam. The foam maintains a slight negative pressure (i.e., below ambient pressure) which retains the ink in the reservoir until it is deposited on the media in a controlled manner. An alternative mechanism for maintaining negative pressure within reservoir 50 is to use a membrane or bladder within the reservoir. The ink replenishing system of the present invention can be used in any cartridge which is provided with a refill port (described below) designed to receive ink and direct it to reservoir 50, without regard to the operative internal structure of reservoir 50.

The top side 51 of cartridge 20, as viewed in FIGS. 2 and 3, includes an air vent opening 52 and an ink refill port 54, both of which are openings which extend through the top wall of container enclosure 44. Vent 52 allows air to enter and exit reservoir 50 as ink is added or drained from the cartridge. Refill port 54 is preferably a partially plugged circular opening, as shown in FIG. 4, or can alternatively be a one-way valve. The refill port allows ink to flow into reservoir 50 from a refill coupling described in detail below. A resilient sealing ring 56 extends around refill port 54 on top wall 51. Sealing ring 56 mates with the refill coupling and also helps confine and direct any ink delivered by the replenishing system into port 54.

Positioned adjacent and immediately above movable carriage 16, when it is in its replenishing station 40, also referred to as the ink resupply position, is a refill container holder 59 which includes a platform 60 supported on printer housing 18. Platform 60 incorporates a plurality of generally circular depressions 62, 64, 66 and 68. Each of the depressions is designed to hold an ink supply container, described below, for replenishing the ink in cartridges 20, 22. Depression 62 is located immediately over the refill port 54 on cartridge 20. Depressions 64, 66, 68 are respectively positioned over the refill ports (described below) on tricolor cartridge 22. In the description which follows, the purpose and structure of depression 62, and the operative elements associated therewith, will be described in detail, with the understanding that the respective functions and elements associated with depressions 64, 66, 68 are generally the same and any important differences will be noted below.

Figure 5:
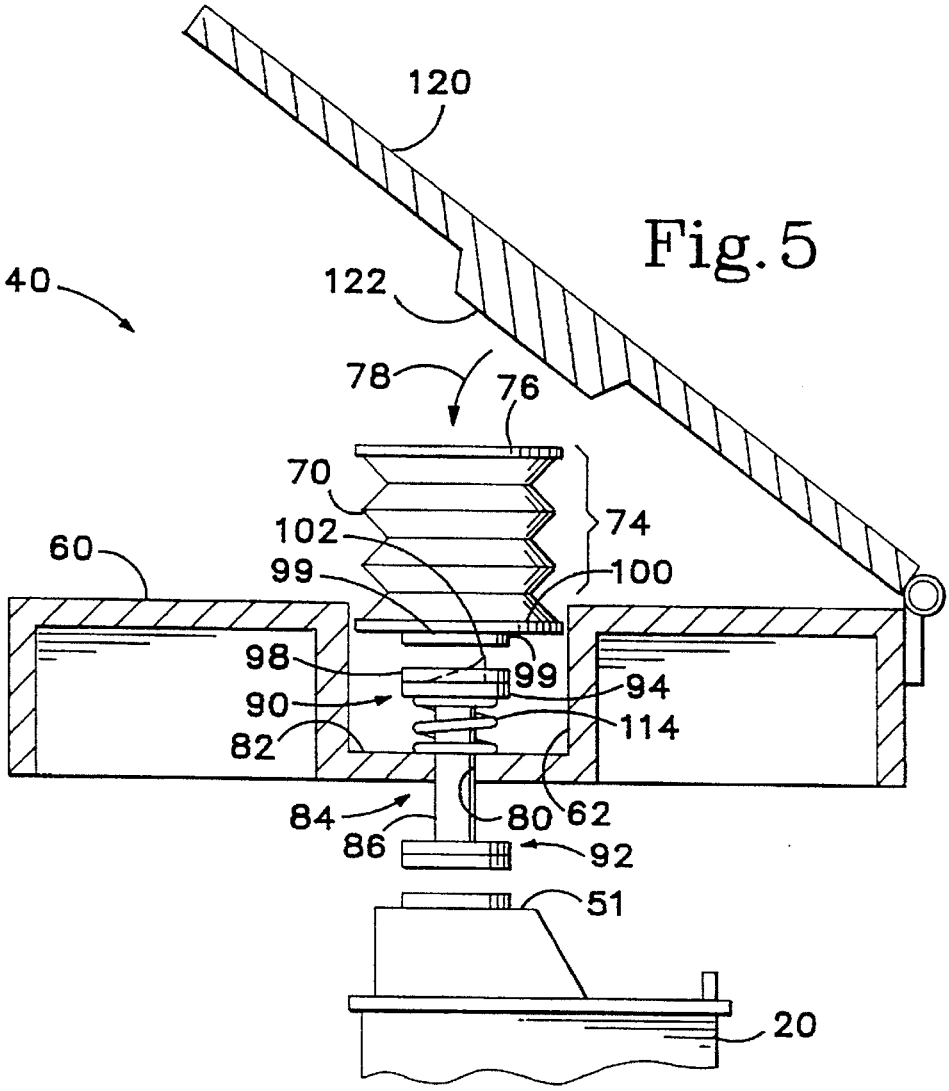
FIG. 5 is an enlarged cross sectional view taken along line 5—5 of FIG. 2 illustrating a portion of the refill system and a step in the procedure for refilling a printhead cartridge.
Figure 6:
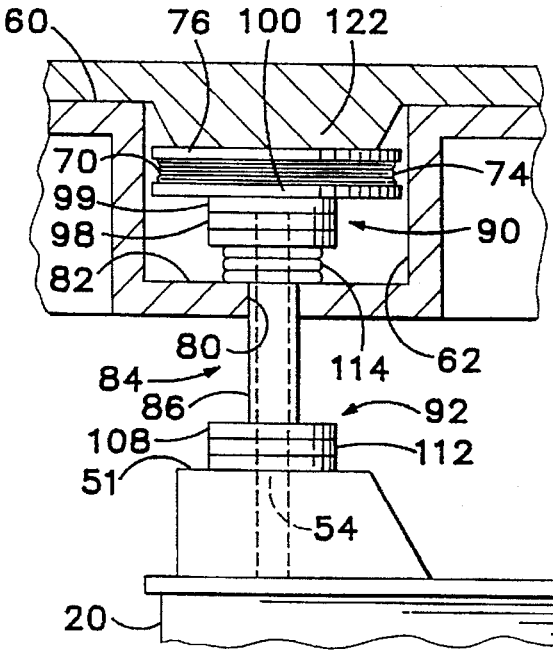
FIG. 6 is a partial cross sectional view as in FIG. 5 illustrating another step in the refill procedure, subsequent to the step shown in FIG. 5, and also showing the hydraulic coupler in its coupled position.

Referring next to FIGS. 2, 5 and 6, platform 60 and depression 62 function as an ink supply container holder on printer 10. Depression 62 is sized and shaped to receive and hold a separate ink supply container 70 which is brought to the printer and inserted in depression 62 whenever the ink reservoir 50 in printhead cartridge 20 needs to be replenished. Ink supply container 70 is preferably a sealed container having a volume sufficient to hold the correct amount of ink required to refill the ink reservoir in a printhead cartridge. The ink reservoir in a standard capacity monochrome cartridge is 20 milliliters (ml). Consequently, an ink supply container for refilling a monochrome cartridge should contain not more than 20 ml of ink, and preferably slightly less, to avoid having to completely exhaust the ink supply before refilling, and also to avoid overfilling. The recommended internal volume for monochrome refill container 70 is 15–18 ml.

Refill container 70 is preferably made of a crushable or collapsible impervious material such as aluminum, plastic or an impervious foil. In keeping with the underlying purpose of refilling the printhead cartridge, which is to promote the reuse of cartridges and to thereby help reduce waste requiring disposal, it is strongly recommended that supply container 70 be made from a single, fully recyclable material. Thin-walled crushable aluminum is suitable for the purpose. The aluminum is preferably fashioned into a small canister of suitable dimensions to enclose an interior volume of 15–18 ml. Because it is preferable to squeeze and partially crush container 70 during the ink refilling process, a bellows-like sidewall structure is provided on the container, as shown in FIGS. 2, 5 and 6. The pleated or bellows-like contours 74 make container 70 uniformly crushable when force is exerted downwardly on the top 76 of the container, as indicated schematically by arrow 78.

Referring to FIGS. 5 and 6, a hydraulic coupler 84 extends through an opening 80 in the bottom wall 82 of depression 62. Coupler 84 is designed to carry ink from container 70 to the refill port 54 on cartridge 20. Hydraulic coupler 84 includes a central tube or conduit 86 which extends through opening 80 in the bottom depression 62. Coupler 84 is supported for sliding up-and-down movement in opening 80. At the upper end of tube 86 is a container connector 90. At the lower end of tube 86 is a refill port connector 92.

FIGS. 3, 5 and 6 illustrate the elements and operation of hydraulic coupler 84. The upper container connector 90 at the upper end of tube 86 is a flattened (i.e., flat or upward-opening and slightly conical) plate 94 with a central opening 96 (see FIG. 2) in registration with the open end of hollow tube 86. A seal ring 98 surrounds central opening 96 and serves to retain any ink which fails to enter tube 86 through opening 96. Ring 98 is preferably a resilient foam or rubber ring which is capable of sealingly contacting a similar ring 99 provided on the bottom wall 100 of container 70. To open or puncture container 70, a upwardly-projecting cutter blade 102 or similar piercing device is positioned centrally on upper plate 94 within ring 98. Piercing blade 102 cuts into the bottom side 100 of container 70 as the container is pushed downwardly into depression 62. Mating sealing rings 98, 99 on coupling 84 and container 70, respectively, are preferably the same size. When container 70 is lowered into depression 62, ring 99 on the container contacts ring 98 on the coupler and rests thereon until downward pressure is exerted on the container. Cutter blade 102 is sized to extend slightly above the top of ring 98 by an amount slightly less than the thickness of ring 99 so that the tip of the cutter blade does not begin to pierce the bottom wall 100 of container 70 until downward pressure is exerted on the container. In other words, the configuration of sealing rings 98 and 99 and cutter blade 102 are such that a container filled with ink can rest within depression 62 with the two sealing rings in contact with one another and without the tip of cutting blade 102 piercing the bottom 100 of the container.

A lower plate 108 similar to upper plate 94 is provided at the lower end of tube 86 on hydraulic coupler 84. Lower plate 108 has a central opening (not shown) in the center of the plate which is in communication with the interior of tube 86. A lower sealing ring 112 is provided on lower plate 108 to mate with the sealing ring 56 on the top wall 51 of cartridge 20.

Coupler 84 is movably supported on printer 10 for vertical movement between upper and lower positions, shown respectively in FIGS. 5 and 6. When the coupler is in its lower position, the lower end plate 108 of coupler 84 presses attached sealing ring 112 against the corresponding and preferably identically-sized ring 56 on cartridge 20, providing a hydraulic connection between tube 86 and refill port 54. Coupler 84 is moved to its lower or coupled position shown in FIG. 6 when ink supply container 70 is pressed downwardly onto the upper end of plate 94 of coupler 84. When that happens, the attached upper sealing ring 98 surrounding cutter blade 102 presses against the corresponding and preferably identically sized sealing ring 99 on the bottom wall 100 of container 70 compressing the rings a sufficient amount for cutter blade 102 to pierce or puncture the bottom wall 100 of container 70 within sealing ring 99. Simultaneously, the coupler 84 moves to its lower position shown in FIG. 6. The result is a completed hydraulic connection between container 70 (in its holder 62) and the refill port 54 on top wall 51 of cartridge 20. The hydraulic connection is provided by tube 86, the sealing rings 98, 99 at the upper end of the coupler and the sealing rings 112, 56 at the lower end of the coupler. The lower position of coupler 84 illustrated in FIG. 6 is referred to as the coupled position. When the coupler is moved back to its upper position, illustrated (for coupler 84) in FIG. 5, the hydraulic coupler 84 is raised above sealing ring 56 on cartridge 20 and the hydraulic connection between container 70 and refill port 54 is broken. Consequently, the upper position of coupler 84 is referred to as the decoupled position. A spring 114 shown in FIGS. 5 and 6 urges hydraulic coupler 84 upwardly to its decoupled position.

It is contemplated that the maximum depth of depression 62 between platform 60 and bottom wall 82 will not exceed 2 cm and might well be less than 1 cm. It is preferable to have the top of perforating blade 102 somewhat below the level of platform 60 when coupler 84 is in its decoupled position in order that container 70 can be positioned within depression 62 before the refilling process begins without puncturing the container. Consequently, the maximum vertical travel of coupler 84 between the coupled and decoupled positions will be less than 1 cm, which is sufficient to allow safe clearance between the top of the seal 56 on ink cartridge 20 and the lower seal ring 112 on coupler 84.

Turning to FIGS. 1, 2 and 5, a hinged cover 120 is supported on container holder printer housing which is supported on 18 adjacent replenishing station 40. The cover is shown closed in FIG. 1 and open in FIG. 2. Cover 120 encloses and covers platform 60 and depressions 62, 64, 66, 68 whenever the ink resupply system of the present invention is not in use. It also serves as a movable lever member on the printer housing for moving into operative contact with and for exerting a force against one or more ink containers positioned in one of the container-receiving depressions 62, 64, 66, 68. Cover 120 also serves to move container 70 into operative contact with the coupler 84 and for moving the coupler to its operative position. Finally, cover 120 can serve as a suitable interlock mechanism to protect against inadvertent use of the ink replenishing station unless movable carriage 16 and appropriate cartridges 20 or 22, or both, are properly positioned at the resupply station in need of additional ink. For example, a suitable interlock (not shown) could be provided on the printer to prevent the opening of cover 120 (the open position is shown in FIG. 2) except when carriage 16 is positioned at replenishing station 40. Or it may be desirable to include, as an additional preventive measure, an interlock which prevents the opening of cover 120 if the ink supply in each ink reservoir on carriage 16 is full (or at least too full to accept additional ink in quantities provided by the supply canisters).

A description of the method will now be provided. To replenish the ink in reservoir 50 of printhead cartridge 20, the following steps in the method of the present invention are followed: (1) The printhead cartridge 20 is positioned or moved to the predetermined resupply position 40 on printer 10; (2) Cover 120 is raised; (3) An ink supply container 70 is positioned in the container holder 59 in depression 62, as shown in FIG. 5, adjacent the printhead cartridge 20; (4) Cover 120 is lowered against the cartridge, as indicated by arrow 78 in FIG. 5, to exert a downward force against container 70, thereby moving the container into operative contact with container opener 102 (by compressing resilient sealing ring 98 downwardly until the knife edge 102 pierces the bottom 100 of container 70); force is also exerted downwardly by cover 120 to effect a hydraulic connection between container 70 and the refill port 54 on printhead cartridge 20, as shown in FIG. 6; and (5) Ink is then caused to flow from the container 70 into the ink reservoir 50 of cartridge 20 via the hydraulic connection 84 and refill port 54. Step (4) collapses or crumples container 70. A suitable projection 122 is preferably provided on cover 120 to cause a portion of the cover to enter depression 62 and completely crush container 70, as shown in FIG. 6.

Figure 7:
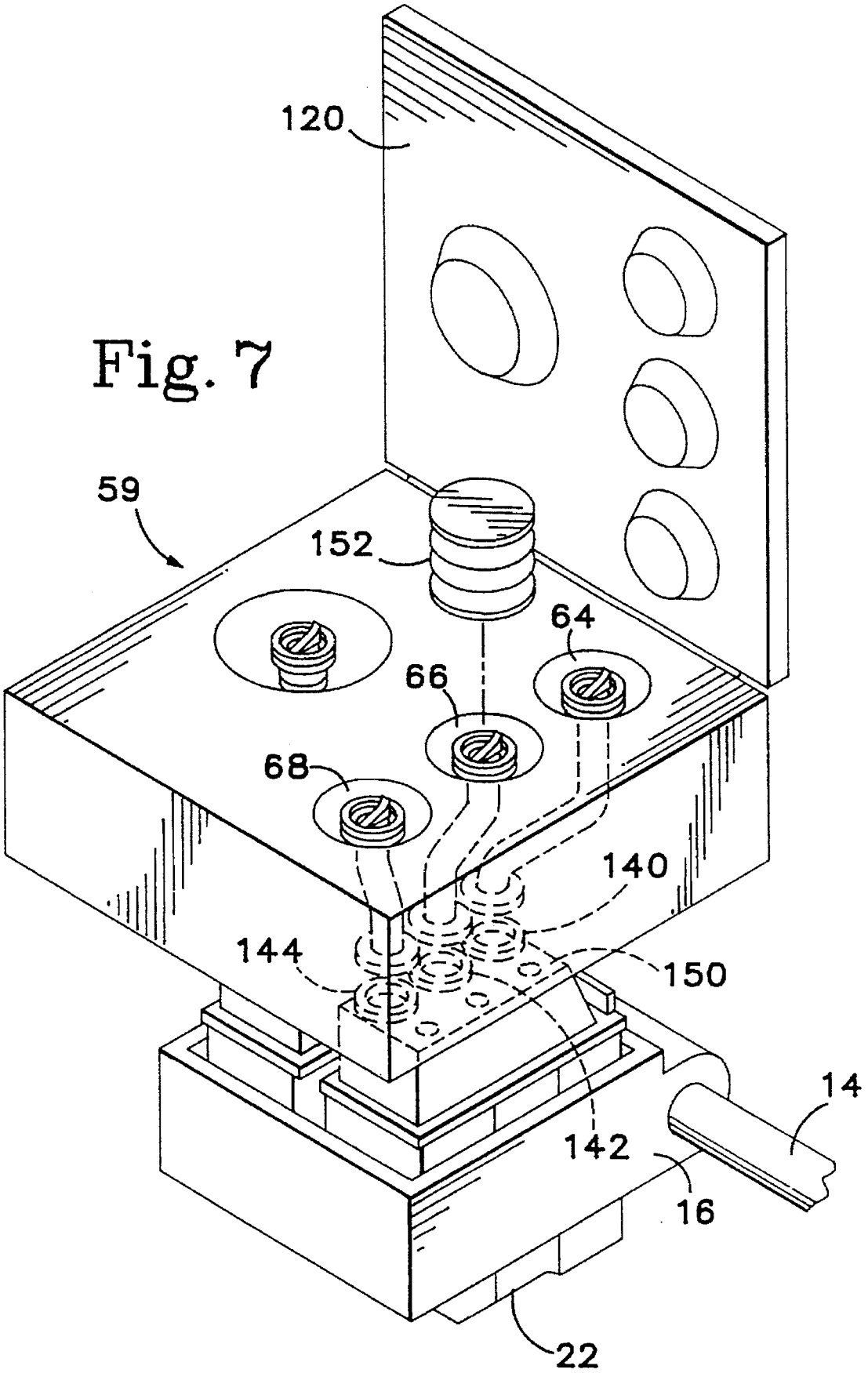
FIG. 7 is a partial isometric detail of a portion of the replenishing station shown in FIG. 2 illustrating the system for refilling a tricolor printhead cartridge.

Referring to FIGS. 2 and 7, the refill apparatus and method for refilling tricolor printhead cartridge 22 is almost the same as the above-described procedure for refilling monochrome cartridge 20. The principle difference is the need to use a somewhat modified configuration of the coupling conduits in the couplers, which hydraulically interconnect the tricolor refill holder depressions 64, 66, 68 with respective refill ports 140, 142, 144 on the top of tricolor cartridge 22. Tricolor cartridge 22 includes three separate ink reservoirs, each of which supplies ink to the tricolor printhead. Other than the provision of three separate reservoirs and three refill ports 140, 142, 144, and the internal plumbing of the cartridge which carries the three inks to the printhead (not shown), cartridge 22 closely resembles monochrome cartridge 20 described above in connection with FIG. 3.

Each refill port 140, 142, 144 communicates hydraulically with a separate ink reservoir in cartridge 22, as is well known to those skilled in the art. The structure of each refill port 140, 142, 144 is the same as is shown in FIG. 4 for monochrome cartridge refill port 54. Each of the tricolor refill holder depressions 64, 66, 68 on holder 59 includes all the elements of monochrome cartridge container holder depressor 62, shown and described in connection with FIGS. 2, 5 and 6. Only two significant differences need to be mentioned. The hydraulic conduits which hydraulically connect holders 64, 66, 68 with refill ports 140, 142, 144, respectively, when the tricolor couplers are in their respective closed positions are not straight, as is conduit 86 in coupler 84. Instead, because of the relative sizes of the top wall 150 on tricolor cartridge 22 and the spacing requirements of container holders 64, 66, 68, the connecting tubes must include elbow bends or suitable curvature in order to complete the necessary hydraulic connections. The other significant difference is in the size of the ink supply containers used to replenish the ink in tricolor cartridge 22. One of the containers 152 for colored ink is illustrated in FIG. 7. Container 152 is the same general configuration as container 70 for black ink and can be made of the same material as container 70. Because each of the three ink reservoirs in tricolor cartridge 22 contains approximately 6 ½ ml of ink, color ink supply container 152 should not exceed 6 ½ ml in volume and will preferably be in the size range 4–6 ml. It is anticipated that only a single colored ink in cartridge 22 will become exhausted at a time. Consequently, only a single cartridge 152 will be placed in holder 59 at a time. The steps in the method of refilling the color ink reservoirs in cartridge 22 are the same as the steps described above for filling the ink reservoir in monochrome cartridge 20.

Alternative embodiments of the ink replenishing apparatus and method are possible within the scope of the present invention. For example, the ink resupply station 40 on printer 10 illustrated in the figures is suggestive only, and other ink resupply positions could be selected. It might be more cost-effective, for example, to incorporate the ink resupply station into service station 26. The plastic cover 25 which partially encloses service station 26 could be replaced by platform 60, with its indentations and hinged cover 120. The ink resupply station could also be incorporated into the top of carriage 16 and carried therewith. The orientation of the ink supply container holder 62, 64, 66, 68, wherein ink supply containers are installed downwardly into upwardly-opening recesses, could be reconfigured to permit the containers to be installed horizontally, with holder 59 oriented along a side wall of the printer housing 18. In such a configuration, the hydraulic couplers between each container holder and the printhead cartridge it refills could also be oriented horizontally and could hydraulically couple to refill ports on the sides of the printhead cartridges. Lever-action door 120 would also be reoriented to exert force against containers in a generally horizontal direction. Also, the number and positions of the ink supply container holders shown in the figures could be modified to include only a single holder for a monochrome printer. The number of ink supply container holders and hydraulic couplers on the refill apparatus will, of course, be directly related to the number of individual ink reservoirs employed on the printer. The holder openings 62, 64, 66 and 68 could also be individually shaped or configured to accept a particular shape or configuration of ink supply container, thereby eliminating the possibility of inadvertently inserting a container with the wrong color ink in a holder. These and other modifications are possible within the scope of the invention.

Industrial Applicability

The present invention serves to extend the life of printhead cartridges used on ink-jet printers by allowing for convenient replenishment of the ink in the ink reservoir. In so doing, the invention helps reduce the expense and waste of having to dispose of a printhead cartridge whenever the ink is exhausted. The system eliminates the user's exposure to ink during refilling, prevents messy spillages and overfilling, and is compatible with existing printhead cartridges if they are equipped with refill ports as described above. The supply containers used to contain and handle the ink are preferably made of recyclable material, which further reduces waste.

While the present invention has been disclosed with reference to the foregoing specification and the preferred embodiment shown in the drawings and described above, it will be apparent to those skilled in the art that changes in form and detail may be made therein without departing from the spirit and scope of the invention as defined by the appended claims.

We claim:

1. A system for replenishing ink in a printhead ink reservoir of an ink-jet printer, the printhead ink reservoir having a refill port, said system comprising:

an ink supply container containing ink used to replenish the ink in the printhead ink reservoir;

an ink supply container holder for holding said ink supply container;

a hydraulic coupler supported on said ink supply container holder for movement between a coupled position in which said coupler provides a hydraulic connection between said ink supply container and the printhead ink reservoir through the refill port, and a decoupled position in which said hydraulic connection is broken, resupply of ink being effected by selectively moving said coupler to said coupled position and transferring ink from said ink supply container to the printhead ink reservoir by way of said hydraulic connection; and a hinged cover on said ink supply container holder, said cover being movable in a first direction to overlie said ink supply container holder to operatively contact said ink supply container for exerting force against said ink supply container to move said ink supply container into operative contact with said coupler and for moving said coupler to said coupled position to establish said hydraulic connection between said ink supply container and said coupler when said coupler is in said coupled position, and movable in a second direction to permit insertion of said ink supply container in said ink supply container holder.

2. A system as in claim 1 in which said hydraulic coupler includes a perforating member thereon for perforating said ink supply container in said ink supply container holder to establish said hydraulic connection between said ink supply container and said coupler.

3. A system as in claim 1 in which the ink jet printer includes a plurality of printhead cartridges containing different inks in a plurality of printhead ink reservoirs, said ink supply container holder including a plurality of holder locations, each location being capable of holding an ink supply container in which ink for resupplying a corresponding one of said printhead ink reservoirs is contained, said ink supply container holder further including a plurality of hydraulic couplers supported on said ink supply container holder for providing a plurality of separate hydraulic connections between respective ones of said ink supply containers and said printhead ink reservoirs.

4. An improved ink-jet printer having a printhead cartridge, and a movable carriage for supporting and transporting the printhead cartridge to selected locations, the printhead cartridge including an ink reservoir for supplying ink to a printhead, the improvement comprising:

an ink resupply position to which the carriage and printhead cartridge thereon are selectively movable to said ink resupply when the ink reservoir requires replenishment;

an ink supply container holder located adjacent said ink resupply position for holding an ink supply container in which ink for replenishing the ink reservoir is contained;

a refill port on the printhead cartridge through which said ink is supplied to the ink reservoir;

a hydraulic coupler supported on the ink supply container holder for movement between a coupled position in which said coupler provides a hydraulic connection between an ink supply container in said holder and said refill port on said cartridge when said cartridge is in said resupply position, and a decoupled position in which said hydraulic connection is broken, resupply of ink being effected by selectively moving said coupler to said coupled position and transferring said ink from said ink supply container in said holder to said refill port through said coupler; and a hinged cover on said ink supply container holder, said cover being movable in a first direction to overlie said ink supply container holder to operatively contact said ink supply container for exerting force against said ink supply container to move said ink supply container into operative contact with said coupler and for moving said coupler to said coupled position to establish said hydraulic connection between said ink supply container and said coupler when said coupler is in said coupled position, and movable in a second direction to permit insertion of said ink supply container in said ink supply container holder.

5. The improvement of claim 4, wherein said ink supply container holder is positioned above said ink resupply position of said carriage and printhead cartridge and said hydraulic coupler is supported on said ink supply container holder for generally vertical movement.

6. A method of replenishing ink in an ink reservoir of a printhead cartridge of an ink-jet printer without removing the cartridge from the printer, the method comprising the following steps:

positioning an ink supply container in an ink supply container holder having a hinged cover and a container opener on the printer adjacent the printhead cartridge;

moving the hinged cover in a first direction to a position wherein the hinged cover overlies the ink supply container holder to operatively contact the ink supply container for exerting force against the container in the holder to move the container into operative contact with the container opener of the printer to open the container, and to effect a hydraulic connection between the container and a cartridge refill port on the printhead cartridge; and causing ink to flow from the container through the hydraulic connection and the refill port, and into the ink reservoir of the printhead cartridge.

7. The method of claim 6 which further comprises a step of continuing to exert force against the container after the hydraulic connection between the container and the container refill port is effected in order to collapse the container and pressurize the ink therein to assist in causing the ink to flow from the container into the ink reservoir of the printhead cartridge.

8. The method of claim 6 including the additional step of automatically determining a quantity of ink in the ink reservoir of the printhead cartridge to determine if the ink reservoir is sufficiently exhausted to require replenishing.

9. The method of claim 6 which further comprises a step of terminating the force exerted against the container to break the hydraulic connection between the container and the refill port on the print cartridge, which is subsequent to the step causing ink to flow from the container.

* * * * *